United States Patent [19]

Beale

[11] Patent Number: 4,743,009

[45] Date of Patent: May 10, 1988

[54] PELVIC POSTURE TRAINING APPARATUS

[76] Inventor: Paxton K. Beale, 161 Alpine Ter., San Francisco, Calif. 94117

[21] Appl. No.: 933,102

[22] Filed: Nov. 20, 1986

[51] Int. Cl.[4] ..... A63B 23/06; A61H 1/02

[52] U.S. Cl. ..... 272/69; 128/75

[58] Field of Search ..... 272/69, 70.2, 70.3, 272/93, 145, 70; 128/25 R, 75, 78, 80 G, 83.5, 92 YZ

[56] References Cited

U.S. PATENT DOCUMENTS

| | | | |
|---|---|---|---|
| 219,439 | 9/1879 | Blend | 128/25 R |
| 2,109,188 | 2/1938 | Bojanova | 128/25 R |
| 3,168,094 | 2/1965 | Siltamaki | 128/75 |
| 3,809,394 | 5/1974 | Hall | 128/25 R X |
| 3,826,491 | 7/1974 | Elder | 272/69 |
| 4,073,290 | 2/1978 | Farrar | 128/75 |
| 4,266,537 | 5/1981 | Bonin et al. | 128/75 |
| 4,462,252 | 7/1984 | Smidt et al. | 73/379 |

FOREIGN PATENT DOCUMENTS

| | | | |
|---|---|---|---|
| 2467000 | of 1981 | France | 272/69 |

*Primary Examiner*—Richard J. Apley
*Assistant Examiner*—David Bender
*Attorney, Agent, or Firm*—Flehr, Hohbach, Test, Albritton & Herbert

[57] ABSTRACT

Apparatus for training a person to walk with proper or improved pelvic posture. The apparatus includes a treadmill and mechanical means for controllably imposing a preselected pelvic posture on a person on the treadmill. A control circuit coupled to the mechanical means causes the mechanical means to impose a preselected pelvic posture on a person on the treadmill for a preselected training time period, and then releases the person's pelvis. Using this apparatus, a person walking on the treadmill can learn to walk with proper pelvic posture by first walking during a training time period with a preselected pelvic posture, and by thereafter walking without being restrained by the mechanical means while trying to maintain the pelvic posture position learned during the training time period.

8 Claims, 7 Drawing Sheets

FIG-1
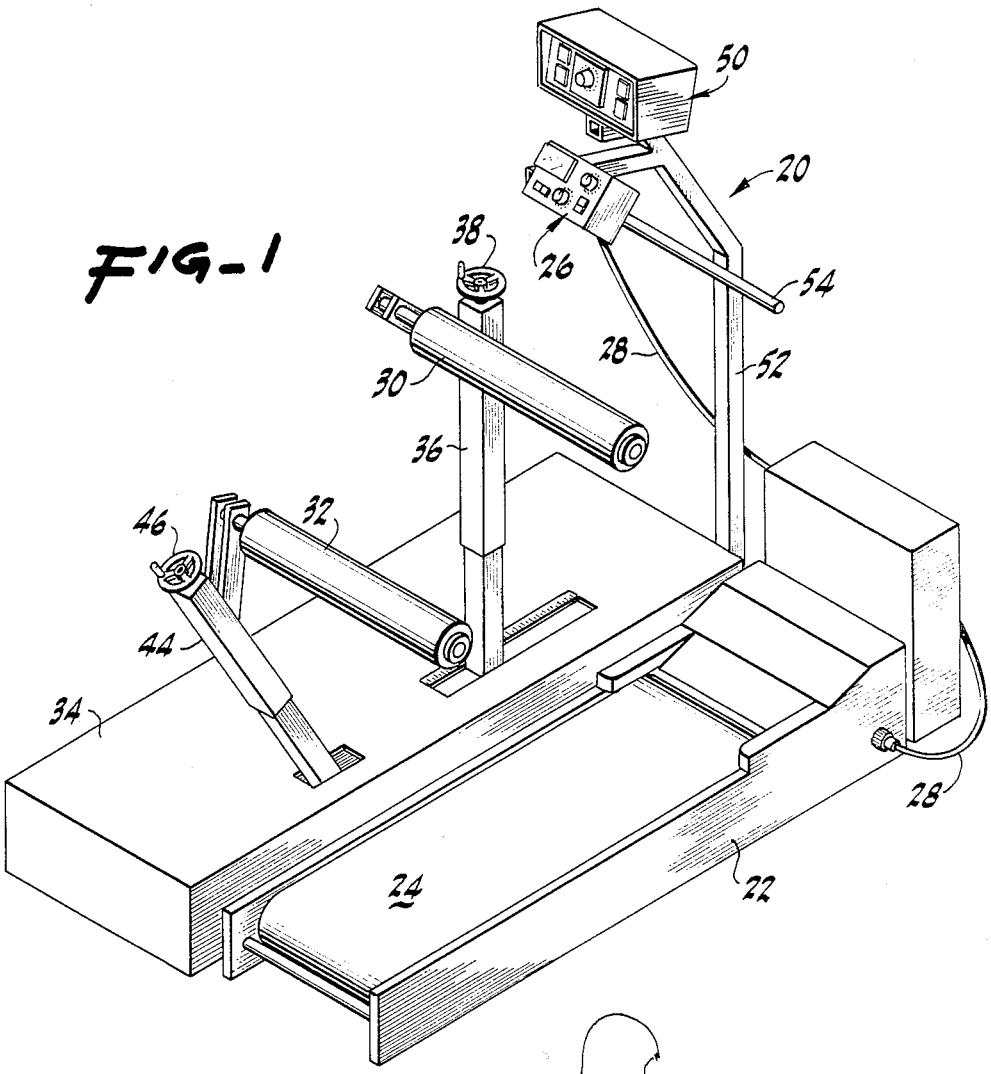
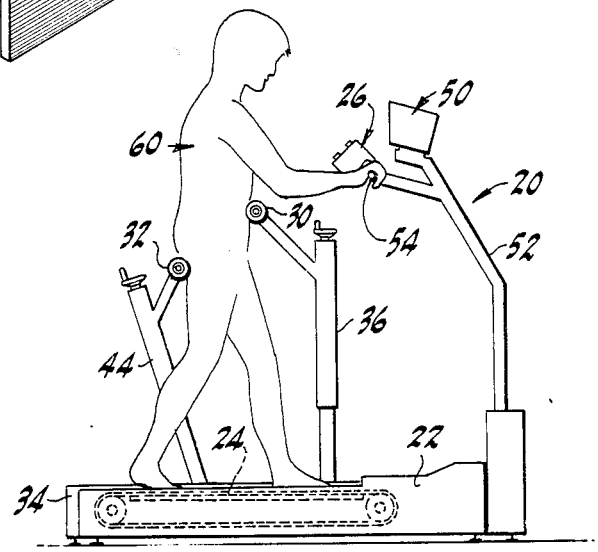
FIG-2

PELVIC POSTURE TRAINING APPARATUS

The present invention relates generally to physical therapy apparatus and more specifically to apparatus for training a person to walk with proper pelvic posture.

BACKGROUND OF THE INVENTION

The present invention, unlike prior art muscle stretching and strengthening exercises, teaches a person pelvic muscle control so that he will learn to automatically move his pelvis into proper posture while walking.

Lower back pain is a persistent and widespread phenomenon. A number of physical and psychological factors, including stress, tension and inadequate abdominal muscle strength, contribute to the development of lower back pain. The failure to walk with proper pelvic posture, however, is the most common causal factor which, if corrected, will eliminate lower back pain. Using the present invention, the failure to walk with proper pelvic posture is readily cured through short term physical therapy.

In layman's terms, the failure to walk with proper pelvic posture is known as having a "sway back" or a hyperextended back. In physiological terms, the problem is one of maintaining an excessive lumbosacral angle while walking, sometimes called lumbar lordosis.

For the purposes of this description, the terms "pelvic posture", "pelvic tilt", "pelvic placement" and "pelvic position" are used synonymously to mean the angle of the pelvis with respect to the vertebral column, which is closely related to the lumbosacral angle, as defined below.

The most commonly prescribed cures for lower back pain are sets of standard back exercises, which are generally aimed at strengthening the abdominal muscles and stretching the back muscles and ligaments.

The present invention, unlike the prior art, emphasizes the teaching of muscle control rather than the building of muscle strength. Muscle control is a dynamic activity. A person cannot maintain a static pelvic posture or tilt while performing a normal range of body movements. The inventor has found that a person does not need much muscle strength to maintain proper pelvic posture; what he needs is good muscle control and good pelvic posture habits. Therefore the present invention teaches a person to automatically move his or her pelvis back into proper posture as the person is walking.

A feature of the present invention is that it corrects a defect in a normal activity, walking, instead of providing a a supplemental activity to help compensate for injury causing activities. Patients frequently stop using supplemental exercise programs once their back stops hurting—thus allowing new injuries to occur. Correction of one's pelvic posture is an injury prevention measure which, as part of a normal daily activity, is easily integrated into one's normal activity pattern and therefore has a greater chance of permanently curing lower back pain than supplemental exercise programs.

Another feature of the present invention is that it provides alternating learning and practicing periods during which, while a person walks on a treadmill, a preselected pelvic tilt or posture is imposed and then the person walks unrestrained—allowing the person to try walking while trying to maintain proper or improved pelvic posture.

It is therefore a primary object of the present invention to provide an apparatus for training a person to walk with proper pelvic posture. Thus the primary object of the apparatus is to teach a skill, rather than to promote muscle strength.

Another object of the present invention is to provide apparatus for imposing a preselected pelvic posture while a person is walking and then releasing the person's pelvis while the person continues to walk in accordance with a preselected schedule.

SUMMARY OF THE INVENTION

In summary, the present invention is an apparatus for training a person to walk with proper pelvic posture. The apparatus includes a treadmill and mechanical means for controllably imposing a preselected pelvic posture on a person on the treadmill. A control circuit coupled to the mechanical means causes the mechanical means to impose a preselected pelvic posture on a person on the treadmill for a preselected training time period, and then releases the person's pelvis. Using this apparatus, a person walking on the treadmill can learn to walk with proper pelvic posture by first walking during a training time period with a preselected pelvic posture, and by thereafter walking without being restrained by the mechanical means while trying to maintain the pelvic posture position learned during the training time period.

BRIEF DESCRIPTION OF THE DRAWINGS

Additional objects and features of the invention will be more readily apparent from the following detailed description and appended claims when taken in conjunction with the drawings, in which:

FIG. 1 is a perspective view from above of the present invention.

FIG. 2 is a side view of a person using the apparatus of the present invention.

DESCRIPTION OF THE PREFERRED EMBODIMENT

Figure 3B:
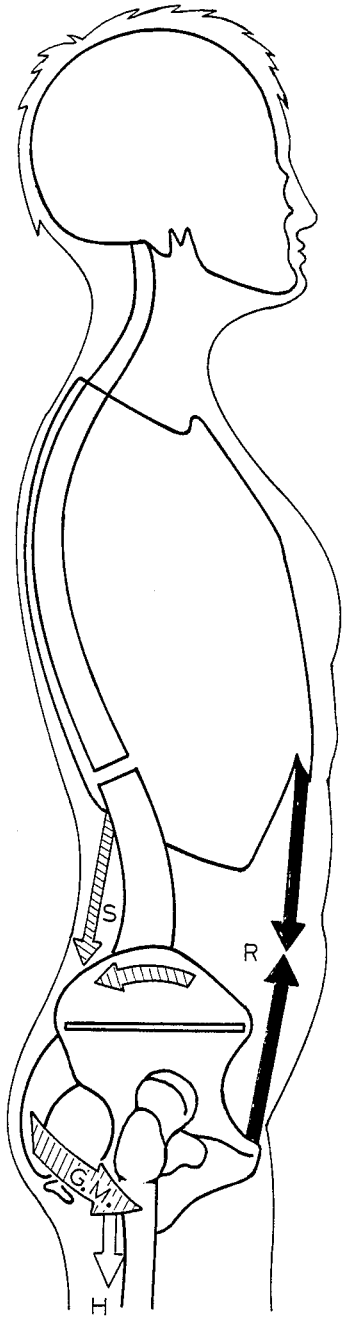
FIGS. 3A and 3B depict a human lumbar vertebral column, pelvis and lower back.

Referring to FIG. 1, there is shown a preferred embodiment of the pelvic posture training apparatus 20 of the present invention. The training apparatus 30 includes a standard treadmill 22 with a continuous belt 24 that is driven by a motor (not shown) at a preselected speed. The power switch and the speed setting dial from the treadmill's belt 24 are located on a first control panel 26 which is coupled to the treadmill 22 by a cable 28 including a plurality of wires (not shown in FIG. 1).

First and second horizontal members 30 and 32 extend from base 34 over the treadmill belt 24. The first horizontal member 30, also called the stomach arm, is attached to base 34 by support and positioning means 36. The support and positioning means 36 includes an adjustment wheel 38 coupled to a screw mechanism 40 (see FIG. 6) for establishing the vertical position of the first horizontal member 30. A motorized horizontal positioning apparatus 42 (see FIGS. 6 and 7) in the base 34 sets the horizontal position of the stomach arm 30 and thereby determines the maximum forward position of the abdomen of the person on the treadmill 22.

The second horizontal member 32, also called the rear arm, is attached to base 34 by support and positioning means 44. The support and positioning means 44 includes an adjustment wheel 46 coupled to a screw mechanism 40 (not shown, but the same as the mechanism for the stomach arm 30) for establishing the vertical position of the rear arm 32 when the rear arm is upright. A motorized positioning apparatus 48 (see FIG. 7) in the base 34 rotates the rear arm on a fulcrum in the base, thereby moving the rear arm between a retracted position and a forward position. The rear arm is shown in the retracted position in FIG. 1 and in a forward position in FIG. 2.

As will be described in more detail below, a second control panel 50 is used to control the horizontal position of the stomach arm and to control the duration of the training period during which the rear arm is in its forward position. The second control panel 50 is coupled to the motors in the base 34 by wires in support member 52.

A handle 54 attached to support member 52 provides a balancing handhold for the person using the apparatus 20.

Referring to FIG. 2, there is shown a side view of the apparatus 20 being used by a person 60. As can be seen, the the stomach arm 30 is positioned against the person's abdomen, and the rear arm 32 is positioned against the lower portion of the person's buttocks. The position of these two arms together impose a preselected pelvic posture on the person 60.

The present invention has two operative time periods: a training period and an unrestrained walking period. During the training period the rear arm 32 is in its forward position as shown in FIG. 2. During the unrestrained walking period the rear arm 32 moves backward to the position shown in FIG. 1, thereby allowing the person 60 to walk without being restrained.

The basic theory of operation, which should not be interpreted as limiting the claims, is that the person will learn by kinesthesia what it feels like to walk with proper pelvic posture during the training period, and then will practice walking unrestrained while trying to maintain the pelvic posture learned during the training period. In the preferred embodiment, the training period can be set from zero to 10 minutes, and is preferably set between 1 and 3 minutes. The practice period can be any length up to 15 minutes, but is preferably 2 to 6 minutes.

In the first preferred embodiment of the invention, the length of the training period is defined by a simple timer mechanism. After the training period the rear arm 32 moves backwards and the person 60 continues to walk for a while to practice what he just learned.

Repetition of the training and practicing sequence several times in a row is usually required to maximize the benefit of using the invention. Therefore, in a second preferred embodiment, the apparatus 20 can be programmed to repeat the sequence of training and practice periods either a specified number of times, or an unlimited number of times until the apparatus is turned off or reset.

Furthermore, experience indicates that a series of training sessions, preferably two or three sessions per day (of ten to thirty minutes each) for five to thirty days, is needed for a person to learn to make walking with proper or improved pelvic posture a part of their normal walking posture and to thereby provide lasting or permanent relief from lower back pain.

Another practical aspect of using the present invention is that learning proper pelvic position is often best achieved by "overtraining": initially, during the early training sessions, it is often best to tilt the patient's pelvis a little further forward than the patient's ideal pelvic position. This helps speed the learning process. In latter sessions, as the patient gains better muscle control, the apparatus can then be reset so that the patient accurately learns the feel of proper pelvic position.

Figure 3A:
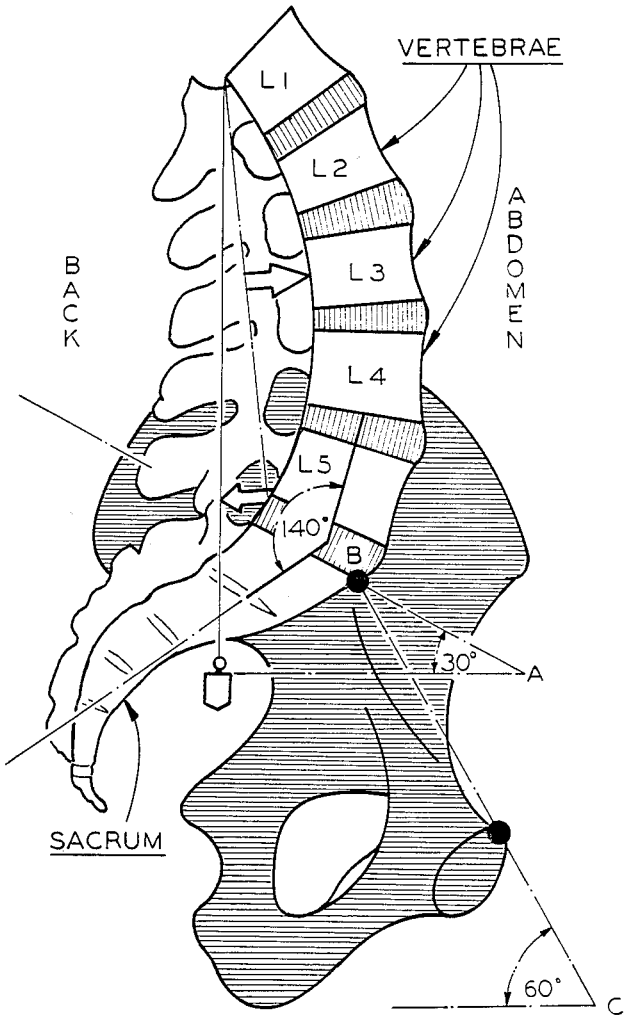

FIG. 3A depicts several angles and parameters typically used to analyze the curvature of the lumbar vertebral column. See Kapaudji, The Physiology of the Joints, vol. 3: Trunk & Vertebral Column, chapter 1A, Churchill Livingstone, New York (1974, 2nd edition). The lower vertebrae are labelled L1 through L5.

The lumbosacral angle (b), defined as the angle between the axis of vertebra L5 and the sacral axis, averages 135 to 140 degrees with proper pelvic posture. Lumbar lordosis is characterized by an abnormally small lumbosacral angle (i.e., smaller than 140 degrees). The goal of using the present invention is to train the patient to walk in "neutral back position" with a larger lumbosacral angle, i.e., closer to the normal 135 to 140 degrees. It should be noted that the best pelvic posture will be different for different patients, but most patients the best pelvic posture will be at or close to the neutral back position.

Other related parameters include the angle of the sacrum (a), which averages 30 degrees; the angle of pelvic tilt (c), which averages 60 degrees; the index of lumbar lordosis (arrow f) which increases with lordosis; and the posterior projection (arrow r) represents the distance between the posteroinferior border of vertebra L5 and the vertical line passing through the posteroinferior border of vertebra L1.

FIG. 3B depicts the primary muscles which are used to reduce lumbar curvature. The process of flattening spinal curvatures is initiated by using the muscles surrounding the pelvis. The forward posture of the pelvis is counterbalanced by the extensor muscles of the hip. As the hamstrings (H) and gluteus maximus (GM) contract they posture the pelvis posteriorly and restore the interspinous line to the horizontal plane. The sacrum also becomes vertical and this reduces the lumbar curvature.

The abdominal muscles, particularly the rectus muscles (R), which span the lumbar curvature, are the crucial muscles in the process of flattening spinal curvature. Contraction of the rectus and gluteus muscles together is sufficient to flatten the lumbar curvature. In addition, contraction of the paravertebral muscles (S) can pull back the upper lumbar vertebrae.

As described above, the theory of operation of the present invention is that use of the present invention teaches the patient to correct lumbar lordosis by learning how his lower back and the related muscles feel when walking with proper pelvic posture.

Figure 4A:
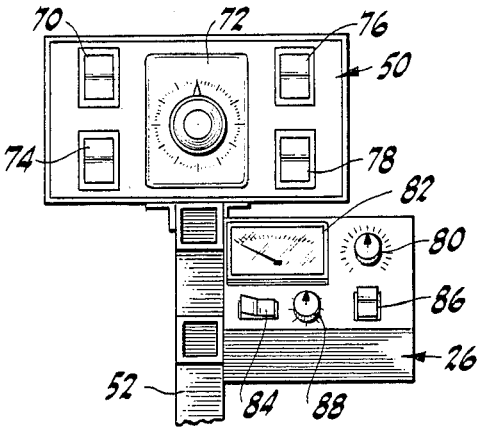
FIG. 4A is a diagram of the control panels of one preferred embodiment.

FIG. 4A is a diagram of the control panels of one preferred embodiment. On the panel 50 for controlling the stomach and rear arms, switch 70 is the power on/-off switch. Dial 72 is coupled to a timer which controls the length of the training period, i.e., the length of time that the rear arm is in its forward position. In other words, after the timer is started and until it times out, the rear arm 32 is in its forward position. Switch 74 turns the timer corresponding to dial 72 on and off.

The stomach arm 30 moves forward and backward when switch 76 is rocked up and down. When the timer for the rear arm is off, the rear arm can be moved back and forth by rocking switch 78 in the corresponding direction.

Control panel 26 is the control panel for treadmill 22. Dial 80 controls the speed of of the treadmill's belt 24, as shown by meter 82. The treadmill's power is turned on and off by switch 84, and the treadmill's belt 24 is activated only so long as the treadmill timer (set by dial 88) is enabled.

Rocking switch 86 elevates and lowers the front of the treadmill belt 24 when the switch 86 is rocked up and down, respectively. By varying the tilt of the treadmill 22, patients can be taught proper pelvic posture while walking not only on level ground, but also while walking uphill and downhill.

Figure 4B:
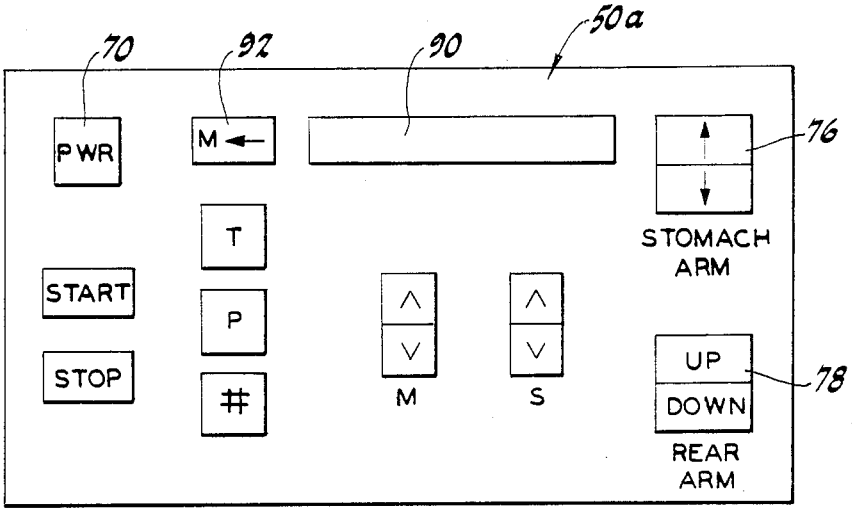
FIG. 4B depicts the control panel of a second preferred embodiment.

FIG. 4B depicts the control panel 50*a* of a second preferred embodiment. This panel uses a digital display 90 to display the length of the training and practice periods (in minutes and seconds) and the number of times the training sequence is repeated. Momentarily depressing the corresponding switch (T for training period, P for practice period, and # for number of repetitions) causes the corresponding quantity to be displayed. The displayed quantity is modified by using the M (minute) and S (second) up/down switches, and the modified quantity is stored by depressing the M key 92. The Start key initiates a training sequence in accordance with the stored training period, practice period, and repetition parameters. The Stop key immediately stops the training sequence and causes the rear arm to move to its back position. Switches 76 and 78 operate the same as for the embodiment shown in FIG. 4A, as described above.

The display 90 shows the training and practice periods in standard minute and second format (i.e., MM:SS) and shows the repetition parameter in simple numerical format (i.e., PP), where M, S and P represent decimal digits.

Figure 5:
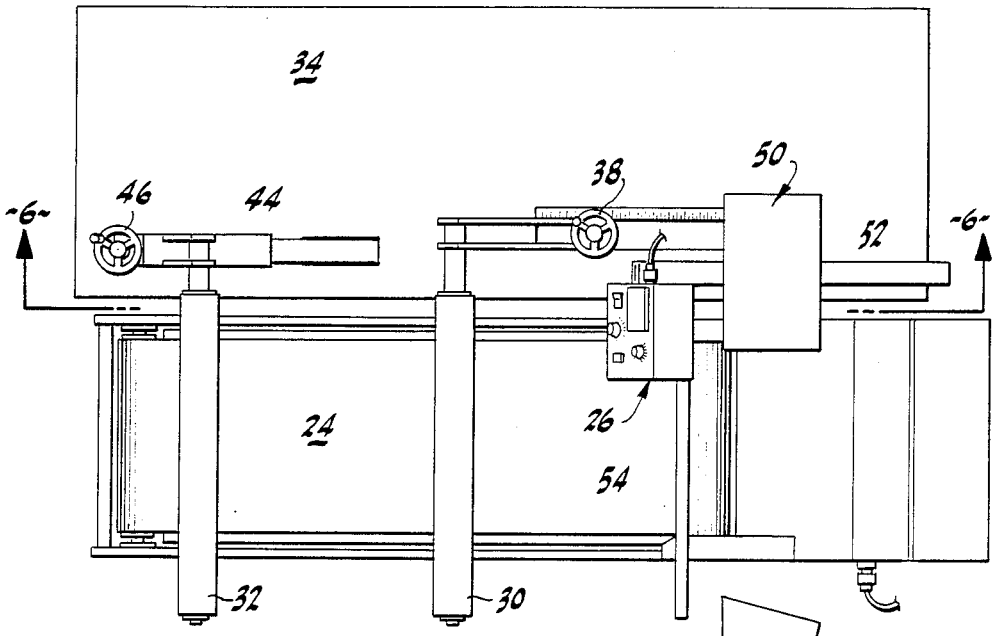
FIG. 5 depicts a plan view of the preferred embodiment.

FIG. 5 depicts an overhead view of the preferred embodiment.

Figure 6:
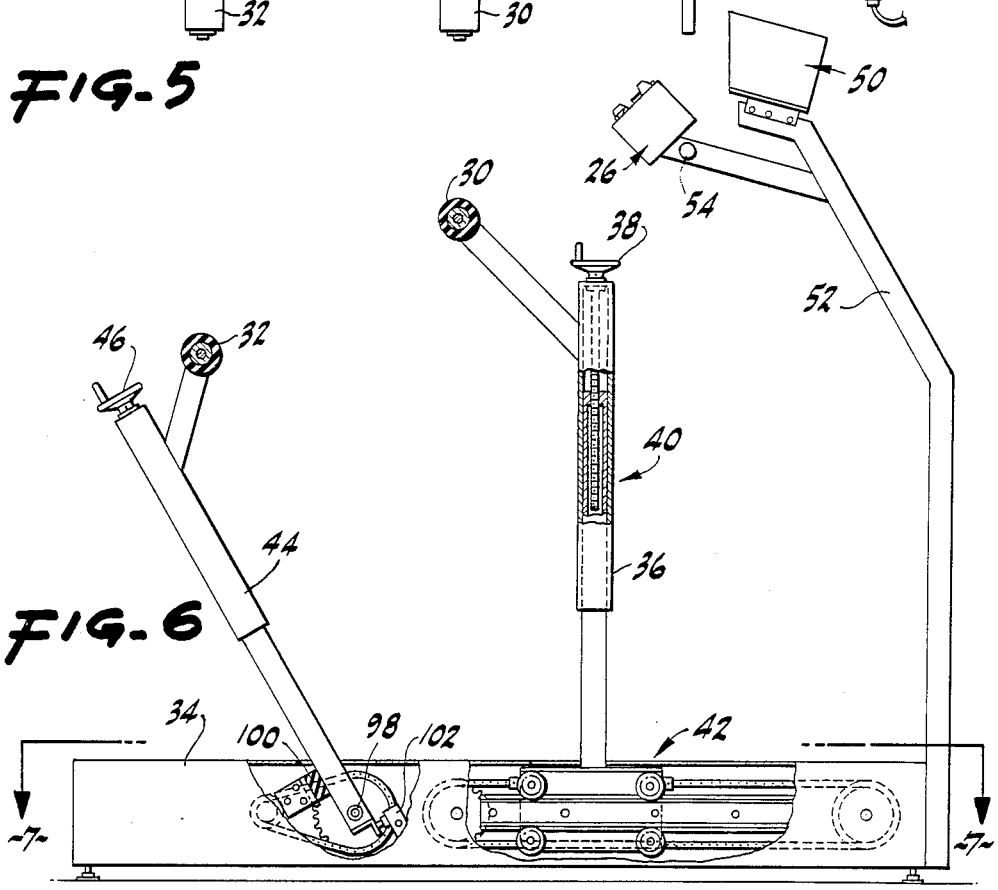
FIG. 6 is a vertical section view of the mechanical aspects of the preferred embodiment taken in the direction of the arrows 6—6 in FIG. 5.

FIG. 6 is a vertical section drawing (corresponding to the section lines in FIG. 5) of the mechanical aspects of the preferred embodiments. Screw mechanism 40 is responsive to the rotation of handle 38 for setting the vertical position of the stomach arm 30. Track mechanism 42, shown in more detail in FIG. 7, moves the stomach arm 30 back and forth.

Positioning apparatus 48 in the base 34 rotates the rear arm 32 on an axle 98 in the base, thereby moving the rear arm 32 between its back and forward positions. Limit switch 100 and micro switch 102 turn off the rear arm positioning apparatus when depressed by support means 44, thereby limiting how far the rear arm 32 can move back and forth.

Figure 7:
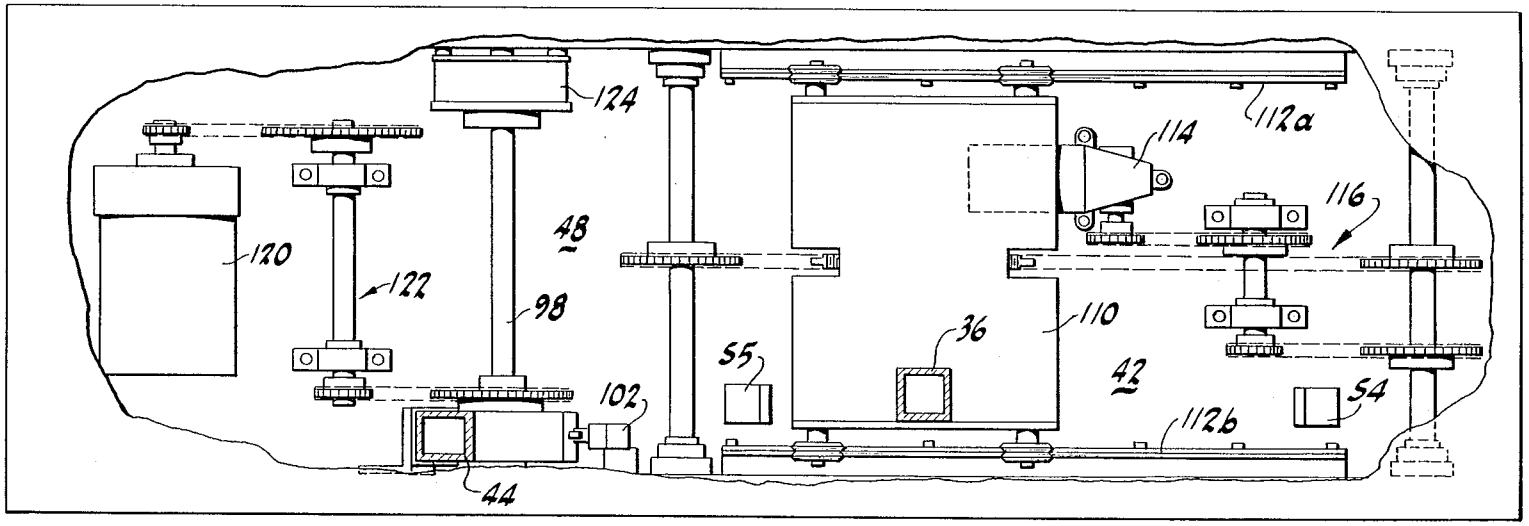
FIG. 7 is a horizontal section view of the mechanical aspects of the preferred embodiment taken in the direction of the arrows 7—7 of FIG. 6.

FIG. 7 is a section drawing (as indicated by the section lines in FIG. 6) of the mechanical drive aspects of the preferred embodiments. The stomach arm's support column 36 is mounted on a platform 110 which rides back and forth on tracks 112*a* and 112*b*. Motor 114 is mechanically coupled to the platform 110 by gear mechanism 116.

The support means 44 for the rear arm 32 is coupled to axle 98. Motor 120 rotates axle 98 to which it is coupled by mechanism 122. When micro switch 102 is depressed by support means 44, the motor 120 is turned off and brake 124 is activated to hold the rear arm 32 in its forward position. Motor 120 is mechanically coupled to the rear arm support 44 by gear mechanism 122.

Figure 8A:
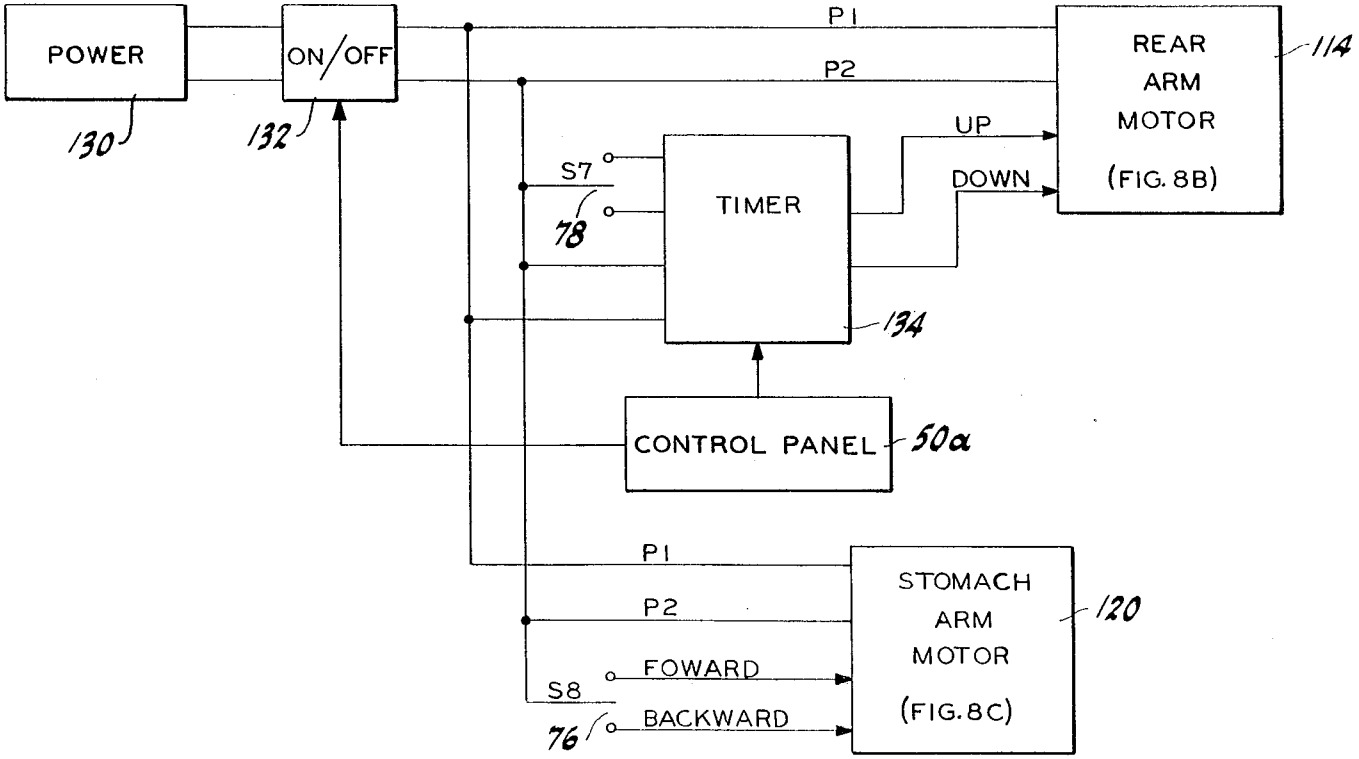
FIGS. 8A, 8B and 8C are diagrams of the electrical aspects of the preferred embodiment.

FIGS. 8A depicts the electrical aspects of the preferred embodiments. The stomach and rear arm motors 120 and 114 are coupled to the a.c. power supply 130 by an on/off safety relay 132, which is controlled by the on/off switch 70. The stomach arm motor 120 is active only when switch S8 (switch 76 in FIGS. 4A and 4B) connects the Forward or Backward lines to power supply line P2.

The rear arm motor 114 is active only when timer 134 connects the Up or Down lines to power supply line P2. In the first preferred embodiment, timer 134 is a simple mechanical timer which forces the rear arm into its forward position whenever the timer is active. Also, when the timer is not active the up/down switch S7 connects the corresponding Up or Down line to power supply line P2; but when the timer is active the circuitry in timer means 134 disconnects switch S7 so that it has no effect on the rear arm motor 114.

In a modification of the first preferred embodiment, the timer means 134 has two mechanical timers. The first mechanical timer controls the length of time for an initial unrestrained walking period, and the second mechanical timer controls the length of the training period. Thus when the apparatus is turned on the rear arm moves (or stays) at its rear position for a period set up by the first mechanical timer, and then the rear arm moves to its forward position for a period set up by the second mechanical timer, and then the rear arm moves back to its rear position.

In a second preferred embodiment, the timer means 134 is a microprocessor based timer using the control panel 50*a* shown in FIG. 4B. Using a conventional microprocessor circuit, the timer means 134 stores three parameters provided by the control panel 50*a*: the length of the training period, the length of the practice period, and the number of times the training sequence is to be repeated. The operation of this embodiment is described in the above discussion of FIG. 4B.

Figure 8C:
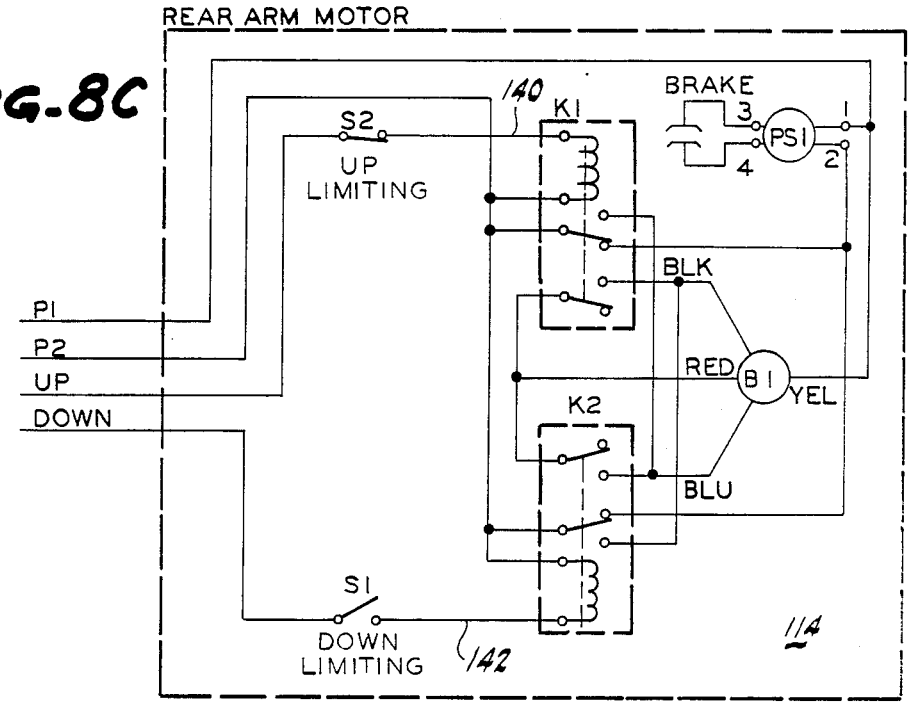
Figure 8B:
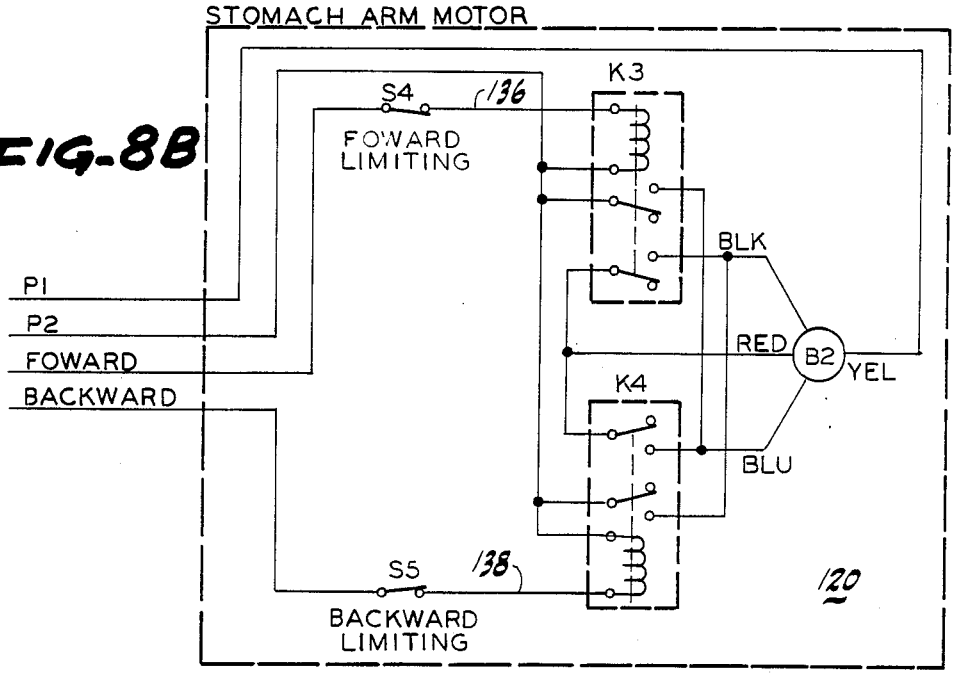

Referring to FIG. 8B, the stomach arm motor 120 includes a conventional motor B2 which drives the stomach arm 30 forward when line 136 is active, and drives it backward when line 138 is active. When the stomach arm is driven to its most forward position the platform 110 contacts a limit switch S4 which disables the motor B2 from moving the arm 30 further forward. Similarly when the stomach arm is driven to its most backward position the platform 110 contacts a limit switch S5 which disables the motor B2 from moving the arm 30 further backward.

Referring to FIG. 8C, the rear arm motor 114 is the same as the stomach arm motor except for the addition of a connection to brake 124. Switch S2 is opened and switch PS1 is closed when the rear arm support 44 contacts micro switch 102 (see FIG. 7). Therefore, when the rear arm 32 reaches its forward position, the motor B1 is turned off and the brake 124 is activated. The brake prevents the rear arm 32 from slipping backward under pressure from the person using the apparatus 20. When the motor B1 is reversed (i.e., driven in the down direction by activating line 142) the micro switch 102 is released, deactivating the brake, and the rear arm 32 retracts until it contacts switch S1 which then disconnects line 142 and turns off the motor.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. Apparatus for training a person to walk with proper pelvic posture comprising:

a treadmill having a walking surface;

mechanical means for directly and controllably imposing a preselected pelvic posture on a person on said treadmill, including first constraint means for defining the maximum forward position of the abdomen of said person on said treadmill, first vertical support means for supporting said first constraint means and having means for adjusting the vertical position of said first constraint means relative to the vertical position of said walking surface, and first horizontal positioning means for moving said first vertical support means so as to adjust the position of said first constraint means to a selectable horizontal position above said walking surface; and second constraint means for defining the position of the lower buttocks of said person at a position corresponding to said preselected pelvic posture, and means for adjusting the vertical position of said second constraint means relative to the vertical position of said walking surface; and control means coupled to said mechanical means for moving one of said constraint means to impose said preselected pelvic posture on a person on said treadmill for a preselected training time period, and for then moving one of said constraint means so as to release said person's pelvis;

whereby a person walking on said treadmill can learn to walk with improved pelvic posture by first walking during said training time period with a preselected pelvic posture, and by thereafter walking without being restrained by said mechanical means while trying to maintain the pelvic posture position learned during said training time period.

2. Apparatus as set forth in claim 1, wherein said control means includes means for repetitively imposing a preselected pelvic posture on said person and then releasing said person for preselected time periods.

3. The apparatus set forth in claim 1, wherein said second constraint means is mounted on a pivoting vertical support coupled to a fulcrum at a fixed position relative to said walking surface, and said control means includes motorized rotating means for rotating said vertical support means about said fulcrum between a back position comprising a preselected position behind said person on said treadmill and a forward position against the lower portion of the buttocks of a person on said treadmill while said first horizontal member is positioned against the abdomen of said person.

4. The apparatus set forth in claim 3 wherein said pivoting vertical support includes position adjusting means for adjusting the vertical position of said second constraint means relative to the vertical position of said walking surface.

5. The apparatus set forth in claim 1, wherein said first horizontal positioning means includes track means situated substantially parallel and adjacent to said walking surface, coupling means for movably mounting said first vertical support means on said track means, and means for moving said coupling means along said track so as to adjust the position of said first constraint means to a selectable horizontal position above said walking surface.

6. Apparatus for training a person to walk with proper pelvic posture comprising:

a treadmill having a walking surface;

a first horizontal member with support and positioning means for positioning said first horizontal member against the abdomen of a person on said treadmill, including first vertical positioning means for adjusting the vertical positioning of said horizontal member relative to the vertical position of said walking surface of said treadmill;

a second horizontal member mounted on a pivoting vertical support coupled to a fulcrum at a fixed position relative to said walking surface, motorized rotating means for rotating said vertical support about said fulcrum between a back position at which said second horizontal member is positioned behind said person on said treadmill and a forward position at which said second horizontal member is positioned against the lower portion of the buttocks of a person on said treadmill while said first horizontal member is positioned against the abdomen of said person, and second vertical positioning means for adjusting the vertical position of said second horizontal member;

and control means coupled to said motorized rotating means for causing said vertical support for said second horizontal member to rotate to and remain at said forward position for a preselected training time period, and to then rotate to said back position;

whereby a person walking on said treadmill can learn to walk with improved pelvic posture by first walking during said training time period with a preselected pelvic posture defined by the positions of said first horizontal member and second horizontal member in said forward position, and by thereafter walking without being restrained by said second horizontal member while trying to maintain the pelvic posture position learned during said training time period.

7. Apparatus as set forth in claim 6, wherein said control means includes means for repetitively imposing a preselected pelvic posture on said person and then releasing said person for preselected time periods.

8. The apparatus set forth in claim 6, further including horizontal positioning means for adjusting the position of said first horizontal member to a selectable position above said walking surface of said treadmill.

* * * * *